US008983326B2

(12) United States Patent
Takeuchi et al.

(10) Patent No.: US 8,983,326 B2
(45) Date of Patent: Mar. 17, 2015

(54) IMAGE FORMING APPARATUS

(71) Applicants: Kenji Takeuchi, Nagoya (JP); Yuki Fukusada, Kasugai (JP)

(72) Inventors: Kenji Takeuchi, Nagoya (JP); Yuki Fukusada, Kasugai (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 1 day.

(21) Appl. No.: 13/767,914

(22) Filed: Feb. 15, 2013

(65) Prior Publication Data

US 2013/0209129 A1 Aug. 15, 2013

(30) Foreign Application Priority Data

Feb. 15, 2012 (JP) ..... 2012-030510

(51) Int. Cl.
*G03G 15/20* (2006.01)

(52) U.S. Cl.
CPC ..... *G03G 15/2046* (2013.01); *G03G 15/2078* (2013.01); *G03G 2215/2035* (2013.01); *G03G 15/2039* (2013.01)
USPC ..... 399/69; 399/43; 399/67; 399/68

(58) Field of Classification Search
USPC ..... 399/43, 45, 67, 68, 69
See application file for complete search history.

(56) References Cited

U.S. PATENT DOCUMENTS

| | | | | |
|---|---|---|---|---|
| 4,634,262 | A * | 1/1987 | Imaizumi et al. | 399/45 |
| 5,289,247 | A * | 2/1994 | Takano et al. | 399/68 |
| 7,257,342 | B2 * | 8/2007 | Hayakawa et al. | 399/68 |
| 7,873,294 | B2 | 1/2011 | Nobe et al. | |
| 8,112,011 | B2 | 2/2012 | Nobe et al. | |
| 2006/0051122 | A1 * | 3/2006 | Kawazu et al. | 399/88 |
| 2007/0059008 | A1 * | 3/2007 | Iwasaki et al. | 399/68 |
| 2007/0230988 | A1 | 10/2007 | Nobe et al. | |
| 2009/0035005 | A1 * | 2/2009 | Tomiyasu et al. | 399/82 |
| 2009/0175646 | A1 * | 7/2009 | Kinouchi et al. | 399/70 |
| 2010/0316404 | A1 * | 12/2010 | Fukuzawa et al. | 399/69 |
| 2011/0076047 | A1 | 3/2011 | Nobe et al. | |

FOREIGN PATENT DOCUMENTS

| | | | |
|---|---|---|---|
| JP | 09237012 | A * | 9/1997 |
| JP | 2007-261154 | A | 10/2007 |

* cited by examiner

*Primary Examiner* — Francis Gray
(74) *Attorney, Agent, or Firm* — Banner & Witcoff, Ltd.

(57) ABSTRACT

An image forming apparatus may include: a heating unit including a heating member that is heated by a heat source and a backup member that forms a nip portion; a feeding unit; and a control unit configured to control the heat source and the feeding unit, wherein the control unit controls the feeding unit such that each of a plurality of recording sheets is fed to the nip portion, wherein some of the plurality of the recording sheets are sequentially conveyed at a second interval to each other, wherein a first recording sheet of the some of the plurality of the recording sheets is fed to have a first interval with respect to a previously conveyed recording sheet, and wherein the control unit increases the output of the heat source on a timing when a front end of the first recording sheet reaches a periphery of the nip portion.

9 Claims, 6 Drawing Sheets

IMAGE FORMING APPARATUS

CROSS-REFERENCE TO RELATED APPLICATION

This application claims priority from Japanese Patent Application No. 2012-030510 filed on Feb. 15, 2012, the entire subject matter of which is incorporated herein by reference.

TECHNICAL FIELD

This disclosure relates to an image forming apparatus including a control unit for controlling a heat source and a feeding unit.

BACKGROUND

It is known that an image forming apparatus includes a heating member that is heated by a heat source, and a backup member that forms a nip portion between the backup member and the heating member, and includes a heating unit that heats a recording sheet in the nip portion, and a feeding unit that feeds the recording sheet toward the nip portion (refer to JP-A-2007-261154). Specifically, in this technology, the control unit is configured to appropriately control the feeding unit when performing duplex printing, thereby alternately conveying recording sheets at a first interval and a second interval smaller than the first interval.

SUMMARY

As a method of controlling the heat source of the above-mentioned heating unit, there is a method, in which the temperature of the heating member is detected, in which the output of the heat source is decreased in a case where the temperature of the heating member exceeds a target temperature, and in which the output of the heat source is increased in a case where the temperature of the heating member is equal to or lower than the target temperature. However, in a case of applying this method to the above-mentioned technology, if two recording sheets are conveyed to the nip portion at the small second interval while the output of the heat source decreases, heat from the nip portion may be taken away by the preceding recording sheet such that the temperature of the nip portion excessively decreases, so that heating on the subsequent recording sheet following immediately after the preceding recording sheet may not be sufficiently performed.

In view of the above, this disclosure provides at least an improvement of heating performance in an image forming apparatus which conveys recording sheets at a first interval and a second interval smaller than the first interval.

An image forming apparatus of this disclosure may include: a heating unit including: a heating member; a heat source configured to heat the heating member; and a backup member facing the heating member, a nip portion being defined between the heating member and a backup member; a feeding unit configured to feed a recording sheet toward the nip portion; and a control unit. The control unit is configured to: control the feeding unit such that each of a plurality of recording sheets is fed to the nip portion at one of a first interval and a second interval smaller than the first interval, some of the plurality of the recording sheets being sequentially conveyed at the second interval to each other, a first recording sheet of the some of the plurality of the recording sheets being fed to have the first interval with respect to a previously conveyed recording sheet, and increase the output of the heat source when a front end of the first recording sheet reaches a periphery of the nip portion.

Here, 'a periphery of the nip portion' includes even positions slightly distant from the nip portion toward the upstream side or downstream side in a conveyance direction.

According to this configuration, the output of the heat source increases on the timing when the front end of the first recording sheet of the some of the plurality of recording sheets conveyed at the small second interval reaches the periphery of the nip portion. Therefore, it is possible to suppress the temperature of the nip portion from excessively decreasing due to the first recording sheet, and it is possible to heat (thermally fix) the second recording sheet well.

According to this disclosure, it is possible to improve heating performance in an image forming apparatus which conveys recording sheets at a first interval and a second interval smaller than the first interval.

BRIEF DESCRIPTION OF THE DRAWINGS

The foregoing and additional features and characteristics of this disclosure will become more apparent from the following detailed descriptions considered with the reference to the accompanying drawings, wherein.

DETAILED DESCRIPTION

Overall Configuration of Laser Printer

First, the overall configuration of a laser printer 1 will be described in brief as an example of an image forming apparatus of this disclosure.

Figure 1:
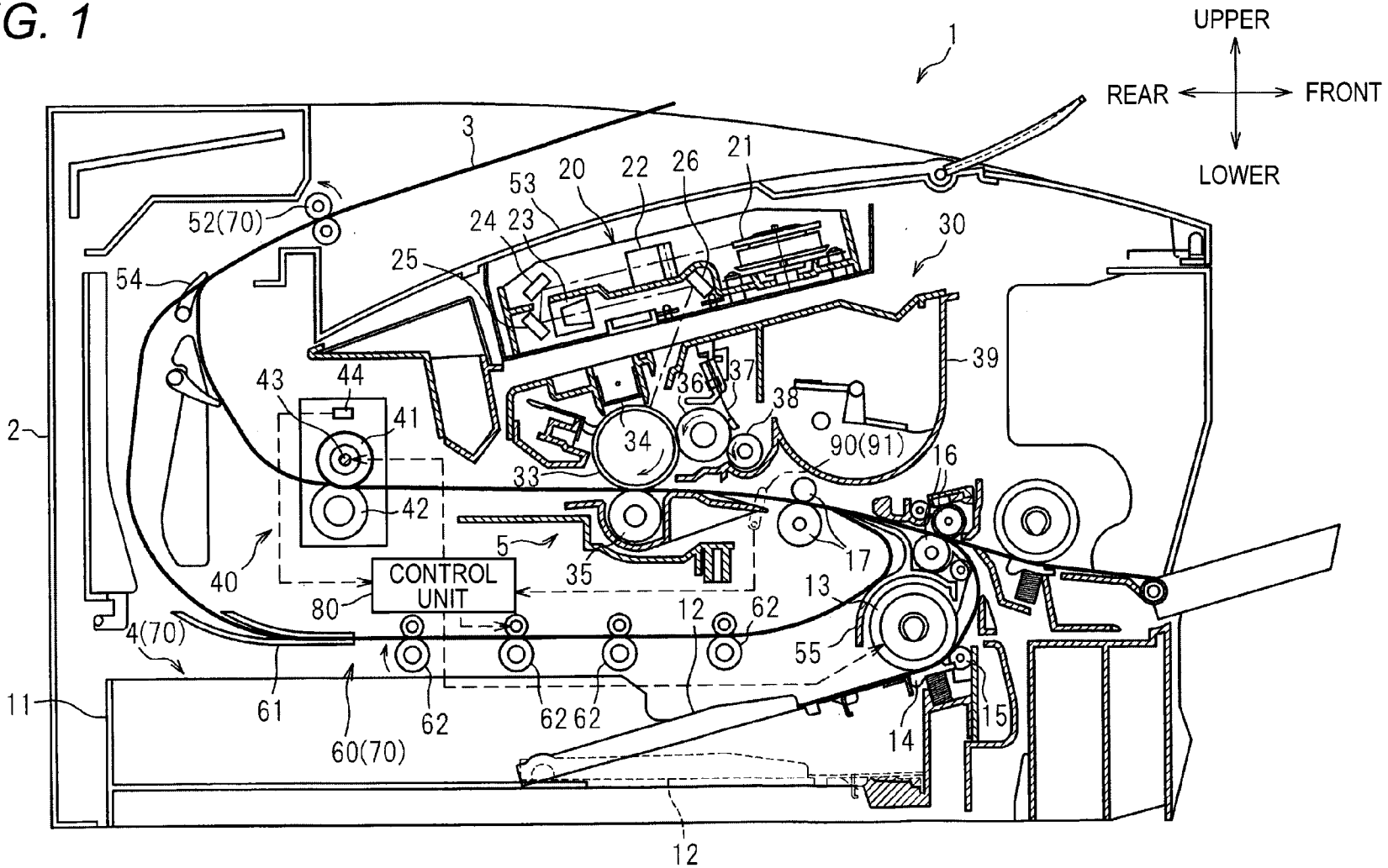
FIG. 1 is a sectional side view illustrating an embodiment of a laser printer as an example of an image forming apparatus of this disclosure.

In the following description, directions of the laser printer 1 refer to the directions as seen from a user facing the laser printer during its use. To be more specific, referring to FIG. 1, a right-side direction and a left-side direction of the drawing sheet are referred to as a "front side" and a "rear side" of the laser printer, respectively. Also, a direction toward the viewer of FIG. 1 is referred to as a "left side", and a direction away from a viewer of FIG. 1 as a "right side". An upper direction and a lower direction in FIG. 1 are referred to as an "upper-lower direction".

As shown in FIG. 1, the laser printer 1 includes a feeder unit 4 and an image forming unit 5 inside a main body 2. The feeder unit 4 feeds a sheet 3 which is an example of a recording sheet, and the image forming unit 5 forms an image onto the fed sheet 3.

The feeder unit 4 includes a sheet feed tray 11 which is mounted at the bottom of the inside of the main body 2 such that the sheet feed tray is detachable, and a sheet pressing plate 12 that is provided inside the sheet feed tray 11. Further, the feeder unit 4 includes a sheet feeding roller 13 and a sheet feeding pad 14 that are provided on the front end portion of the sheet feed tray 11, and paper dust removing rollers 15 and 16 that are provided on the downstream side relative to the sheet feeding roller 13 in the conveyance direction of the sheet 3. Furthermore, the feeder unit 4 includes registration rollers 17 that are provided on the downstream side relative to the paper dust removing rollers 15 and 16.

Between the registration rollers 17 and a photosensitive drum 33 to be described below, a sheet passage sensor 90 for detecting existence or non-existence of the sheet 3 is provided. Also, the sheet passage sensor 90 has a known structure. In brief, the sheet passage sensor 90 is configured by a detecting arm 91 movable by abutting on the sheet 3, and an optical sensor for detecting movement of the detecting arm.

In the feeder unit 4, the sheets 3 in the sheet feed tray 11 are pulled toward the sheet feeding roller 13 by the sheet pressing plate 12, are fed one by one by the sheet feeding roller 13 and the sheet feeding pad 14, and are conveyed to the image forming unit 5 through various rollers 13 to 16.

The image forming unit 5 includes a scanner unit 20, a processing cartridge 30, and a fixing device 40 which is an example of a heating unit.

The scanner unit 20 is provided at the upper portion of the inside of the main body 2 and includes a laser-beam emitting unit (not shown), a polygon mirror 21 which is driven to rotate, lenses 22 and 23, and reflective mirrors 24, 25, and 26. Further, in the scanner unit 20, a laser beam is irradiated onto the surface of the photosensitive drum 33 of the inside of the processing cartridge 30 through a path shown by a chain line in FIG. 1, so that high-speed scanning is performed.

The processing cartridge 30 is provided below the scanner unit 20, and it is attachable to and detachable from the main body 2. Further, the processing cartridge 30 includes the photosensitive drum 33, a scorotron charger 34, a transfer roller 35, a developing roller 36, a layer-thickness regulating blade 37, a feeding roller 38, and a toner hopper 39.

In the processing cartridge 30, the surface of the photosensitive drum 33 charged by the scorotron charger 34 is exposed by the laser beam from the scanner unit 20, so that an electrostatic latent image is formed on the photosensitive drum 33. Toner in the toner hopper 39 is fed to the electrostatic latent image through the feeding roller 38 and the developing roller 36, so that a toner image is formed on the photosensitive drum 33. Then, when the sheet 3 is conveyed between the photosensitive drum 33 and the transfer roller 35, the toner image carried on the photosensitive drum 33 is transferred onto the sheet 3, so that an image is formed on the sheet 3.

The fixing device 40 is a device for fixing thermally the toner image transferred on the sheet 3, and it is disposed on the downstream side of the processing cartridge 30 and includes a heating roller 41 which is an example of a heating member, a pressing roller 42 which is an example of a backup member, and a center thermistor 44 which is an example of a temperature detecting member.

The heating roller 41 is a cylindrical member for heating the sheet 3, and it is configured to be heated by a halogen lamp 43 which is an example of a heat source provided inside the heating roller 41.

The pressing roller 42 is disposed to face the heating roller 41, and it is pressed toward the heating roller 41 such that a nip portion is formed between the pressing roller 42 and the heating roller 41.

The center thermistor 44 is a sensor for detecting the temperature of the center portion of the heating roller 41, and it is provided to face the center portion of the heating roller 41.

In the fixing device 40, when the sheet 3 passes through the nip portion between the heating roller 41 and the pressing roller 42, the toner image on the sheet 3 is thermally fixed by the heating roller 41. Then, the sheet 3 thermally fixed by the fixing device 40 is discharged to a sheet discharge tray 53 of the outside of the main body 2 by a discharging roller 52 rotating normally.

Also, during duplex printing, the discharging roller 52 rotates reversely before the entire sheet 3 is discharged onto the sheet discharge tray 53, thereby returning the sheet into the main body 2. The sheet 3 returned into the main body 2 is sent to a double-side conveyance path unit 60 through the rear side of the fixing device 40 by switching of a flapper 54.

The double-side conveyance path unit 60 is a device for double-side conveyance, and it is disposed between the fixing device 40 and the processing cartridge 30, and the sheet feed tray 11. Here, 'the double-side conveyance' means a conveyance which is performed to return the sheet 3 to the upstream side of the processing cartridge 30 with the sheet 3 upside down, thereby performing the rear surface of the sheet 3 whose front surface has been printed.

The double-side conveyance path unit 60 includes a guide member 61 that switches the direction of the sheet 3 conveyed downward through the rear side of the fixing device 40 to the front side, and multiple returning rollers 62 that are arranged in the front/rear direction for returning the sheet 3 guided by the guide member 61 to the upstream side of the photosensitive drum 33 (the registration rollers 17). Then, the sheet 3 discharged from the double-side conveyance path unit 60 is guided toward the registration rollers 17 with the sheet 3 upside down by a guide 55 which is on the front side of the double-side conveyance path unit 60. Therefore, after the front end of the sheet 3 is straightened by the registration rollers 17, the sheet 3 is sent to the photosensitive drum 33, and then the toner image of the photosensitive drum 33 is transferred onto the rear surface of the sheet 3.

In other words, in the present embodiment, a feeding unit 70 for feeding the sheet 3 toward the nip portion between the heating roller 41 and the pressing roller 42 is configured by the above-mentioned feeder unit 4, the double-side conveyance path unit 60, and other rollers (such as the discharging roller 52) contributing to the conveyance of the sheet 3. Further, the feeding unit 70 and the halogen lamp 43 of the fixing device 40 are controlled by a control unit 80.

Control Unit

Now, the control unit 80 will be described in detail.

As shown in FIG. 1, the control unit 80 includes, for example, a CPU, a RAM, a ROM, and an input/output circuit, and performs arithmetic processing based on inputs from the above-mentioned sheet passage sensor 90 and the center thermistor 44, the contents of a print instruction, programs and data stored in the ROM, and the like, thereby performing print control, control on the feeding unit 70, and the halogen lamp 43, and the like.

Specifically, the control unit 80 is configured to control the feeding unit 70 such that the plurality of sheets 3 is fed to the nip portion at a first interval and a second interval smaller than the first interval. In detail, the control unit 80 is configured to alternately perform a conveyance at the first interval and a conveyance at the second interval when performing duplex printing on the sheets 3.

This control will be described below with reference to FIGS. 2A to 2C in brief, not in detail.

Figure 2A:
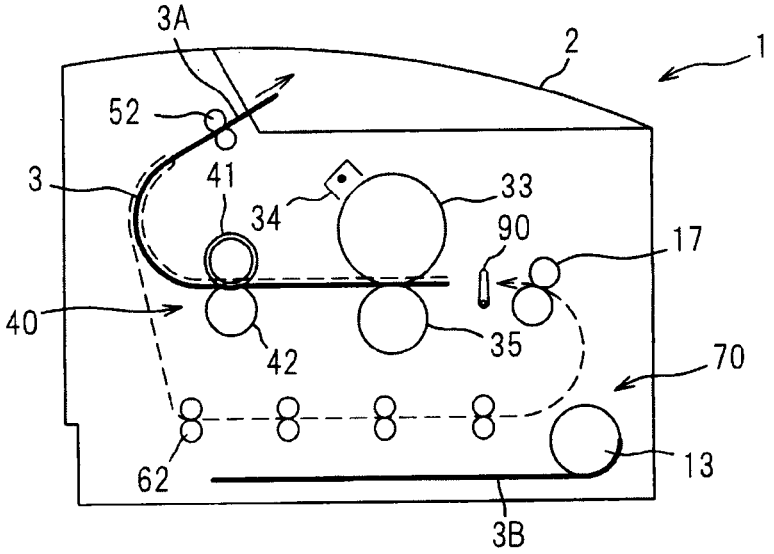
FIGS. 2A to 2C are views illustrating a control to alternately convey a plurality of sheets at a first interval and a second interval.

As shown in FIG. 2A, if receiving an instruction to perform duplex on the plurality of sheets 3, the control unit 80 first controls the feeding unit 70 such that a first sheet 3A is conveyed from the sheet feeding roller 13 toward the nip portion of the fixing device 40. If printing on the front surface of the first sheet 3A terminates, the control unit 80 controls the feeding unit 70 such that the sheet 3A passes a route shown by a broken line in FIG. 2A, so that it proceeds rear-surface print control.

Figure 2B:
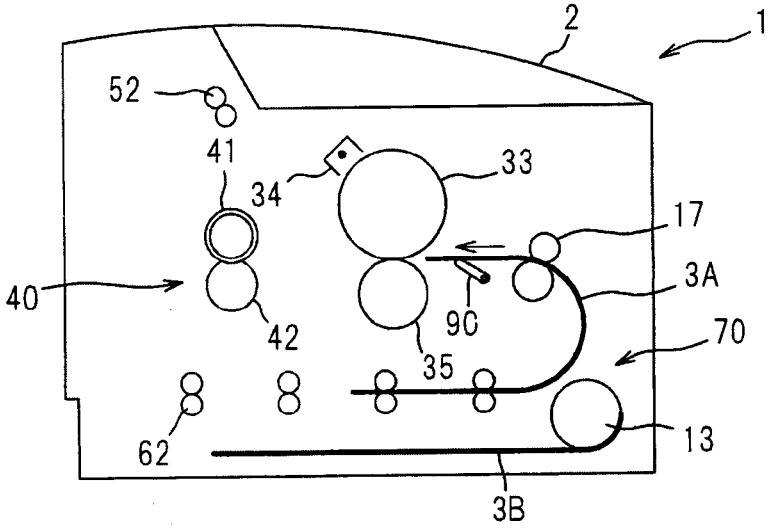
Figure 2C:
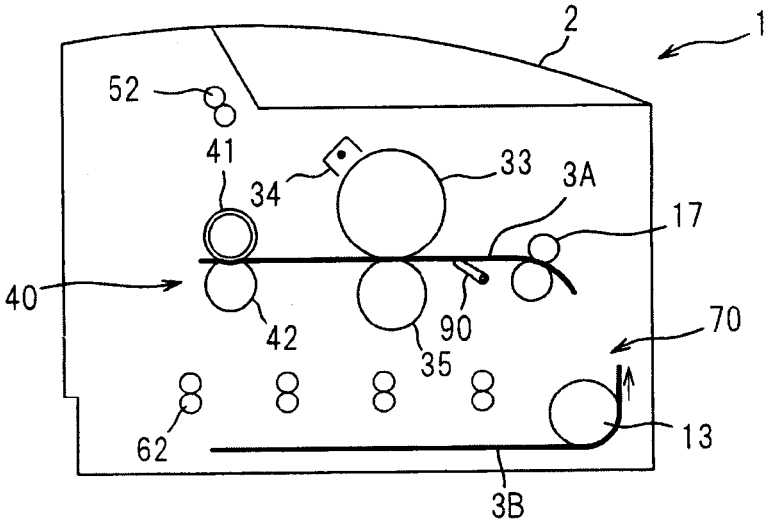

Therefore, a time interval from the rear end of the sheet 3A conveyed for front-surface print being passed the sheet passage sensor 90 such that the sheet passage sensor 90 is turned off to the front end of the sheet 3A re-conveyed for rear-surface print being reached the sheet passage sensor 90 as shown in FIG. 2B such that the sheet passage sensor 90 is turned on is lengthen.

In other words, an interval (sheet interval) between the rear end of the sheet 3A conveyed for front-surface print and the front end of the sheet 3A newly re-conveyed for rear-surface print is set to a very long first interval T1 (see FIG. 3) corresponding to the route shown by the broken line. Here, the sheet interval is intended to include not only an interval between two sheets 3 actually conveyed but also an interval between the rear end of the sheet 3A conveyed for front-surface print and the front end of the sheet 3A conveyed for rear-surface print as described above.

Next, the control unit 80 controls the feeding unit 70 such that the a second sheet 3B is conveyed from the sheet feeding roller 13 toward the nip portion of the fixing device 40 at an appropriate timing during the rear-surface print on the first sheet 3A. Therefore, a sheet interval between the rear end of the first sheet 3A for rear-surface print and the front end of the second sheet 3B for front-surface print is set to a second interval T2 (see FIG. 3) smaller than the first interval T1.

In the following description, for the sake of convenience, the first to last sheets 3 for front-surface print are referred to as sheets SX1, SX2, . . . , and the first to last sheets 3 for rear-surface print are referred to as sheets DX1, DX2, . . . .

Figure 3:
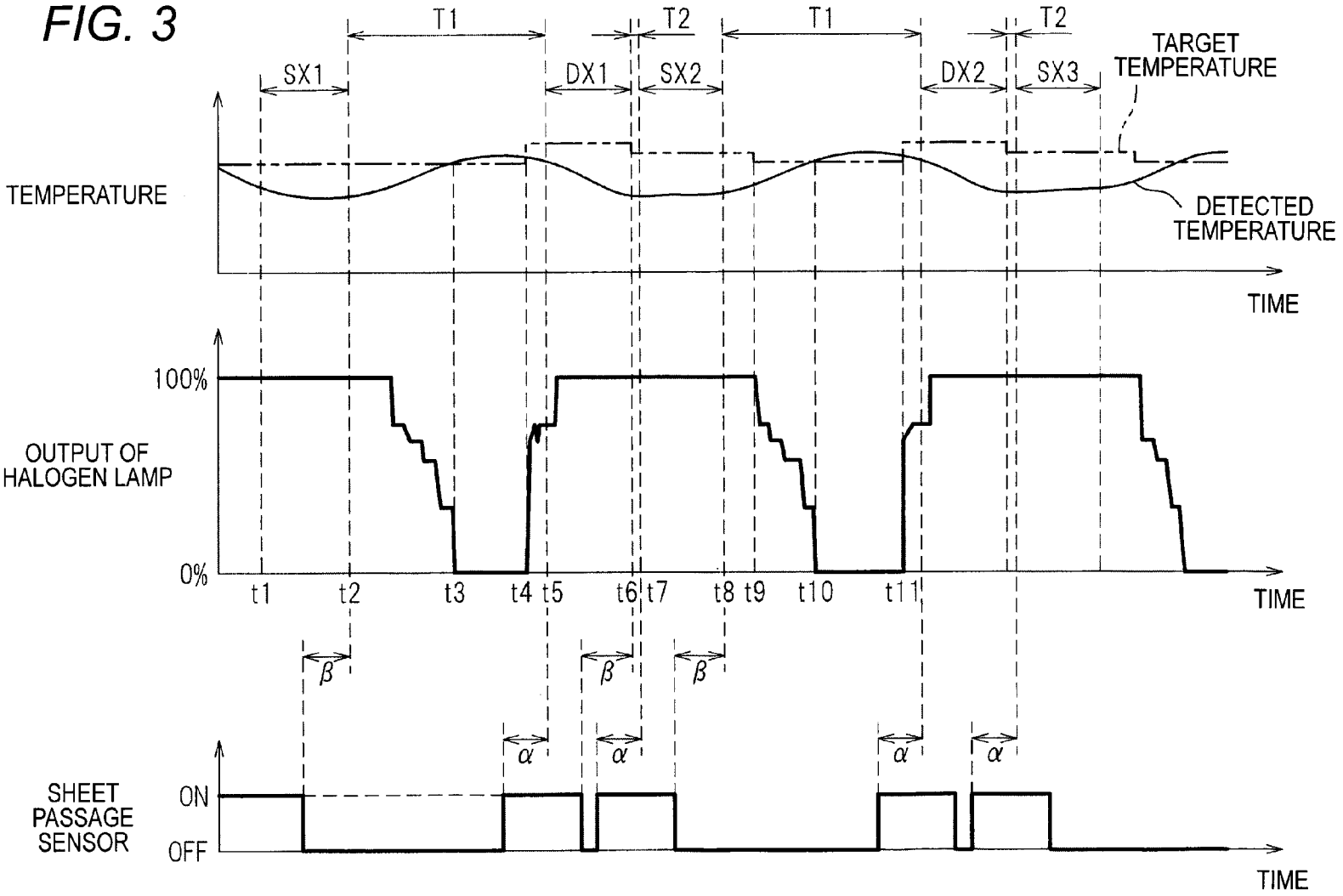
FIG. 3 is a time chart illustrating changes of individual parameters during duplex printing.

Also, as shown in FIG. 3, the control unit 80 is configured to increase the output of the halogen lamp 43 in a case where the current value of the detected temperature detected by the center thermistor 44 is lower than the target temperature (times t4 and t11), and decrease the output of the halogen lamp 43 in a case where the current value is higher than the target temperature (times t3 and t10).

Specifically, in the case where the detected temperature is higher than the target temperature, the control unit 80 turns off the halogen lamp 43, and in the case where the detected temperature is lower than the target temperature, the control unit 80 performs duty control to increase or decrease the output based on a difference between the detected temperature and the target temperature. For example, in a case where the difference between the detected temperature and the target temperature is equal to or greater than a predetermined value, the control unit 80 performs control such that the duty ratio becomes 80%, and in a case where the difference between the detected temperature and the target temperature is less than the predetermined value, the control unit 80 performs control such that the duty ratio becomes 60%.

Further, the control unit 80 is configured to increase the output of the halogen lamp 43 at the timing (around a time t5) when the front end of a first sheet (DX1) of two sheets (DX1 and SX2) sequentially conveyed at the second interval T2 with the first interval T1 relative to the previously conveyed sheet (for example, SX1) reaches the periphery of the nip portion.

Therefore, the output of the halogen lamp 43 increases on the timing (around the time t5) when the front end of the first sheet (DX1) of the two sheets (DX1 and SX2) conveyed at the small second interval T2 reaches the periphery of the nip portion. As a result, it is possible to suppress the temperature of the nip portion from excessively decreasing by the first sheet (DX1), and it is possible to thermally fix the second sheet (SX2) well.

In FIG. 3, a times t1, t5, or t7 represents a time when the front end of a sheet 3 reaches the nip portion, that is, a time that is after a time a from when the front end of the sheet 3 contacts the sheet passage sensor 90 and the sheet passage sensor 90 is turned on and to when the front end reaches the nip portion. Also, a time t2, t6, or t8 represents a time when the rear end of a sheet 3 reaches the nip portion, that is, a time that is after a time β from when the rear end of the sheet 3 leaves the sheet passage sensor 90 and the sheet passage sensor 90 is turned off and to when the rear end reaches the nip portion.

Specifically, in the present embodiment, the control unit 80 is configured to increase the output of the halogen lamp 43 (the time t4) immediately before the time (the time t5) when the front end of the first sheet (DX1) reaches the nip portion.

Therefore, for example, as compared to a form in which the output of the halogen lamp 43 increases immediately after the front end of the first sheet (DX1) passes through the nip portion, it is possible to further suppress the temperature of the nip portion from excessively decreasing by the first sheet (DX1). Also, in the present embodiment, the control unit 80 raises (changes) the target temperature at the time t4, thereby increasing (changing) the output of the halogen lamp 43.

Also, the control unit 80 is configured to decrease the output of the halogen lamp 43 (target temperature) on a timing when the rear end of the first sheet (DX1) reaches the periphery of the nip portion (around a time t6). In other words, the control unit 80 steps down the target temperature having been raised at the time t4 (to a temperature higher than an initial value) at the time t6, thereby performing control such that the output of the halogen lamp 43 decreases.

Also, in the example shown in FIG. 3, at the timing (around the time t6) when the rear end of the first sheet (DX1) reaches the periphery of the nip portion, since the detected temperature is sufficiently low, the actual output of the halogen lamp 43 does not decease. If the detected temperature around the time t6 is high, the above-mentioned configuration is effective. In other words, if the detected temperature around the time t6 is slightly lower than the target temperature having been raised at the time t4, the target temperature is stepped down, so that the target temperature becomes lower than the detected temperature, and thus it is possible to decrease the output of the halogen lamp 43. Therefore; it is possible to suppress the temperature of the nip portion from overshooting after the rear end of the first sheet (DX1) leaves the nip portion.

Also, the control unit 80 is configured to decease the output of the halogen lamp 43 (target temperature) on a timing (around the time t8) when the rear end of the last sheet (SX2) of the two sheets (DX1 and SX2) sequentially conveyed at the second interval T2 reaches the periphery of the nip portion. Therefore, it is possible to suppress the temperature of the nip portion from overshooting after the rear end of the last sheet (SX2) leaves the nip portion (after the time t8).

Specifically, in the present embodiment, the control unit 80 is configured to decrease the output of the halogen lamp 43 after the rear end of the last sheet (SX2) of the two sheets (DX1 and SX2) sequentially conveyed at the second interval T2 leaves the nip portion (a time t9). Therefore, the output of the halogen lamp 43 does not decrease until the rear end of the last sheet (SX2) passes through the nip portion, and thus it is possible to surely suppress fixation defects.

Also, in the present embodiment, the target temperature lowers to the initial value at the time t9, so that the output of the halogen lamp 43 decreases. In other words, the control unit 80 is configured to gradually (stepwise) lower the target temperature to the initial value as the target temperature having been greatly changed from the initial value at the time t4 lowers.

Therefore, as compared to a form in which the target temperature lowers to the initial value at once, for example, even in a case where the halogen lamp 43 is turned off before the last sheet (SX2) enters the nip portion, the temperature of the nip portion lowering while the last sheet (SX2) passes through the nip portion reaches a second target value (a target value between the initial value and a maximum value) before reaching the initial value of the target temperature, and thus it is possible to early turn on the halogen lamp 43 again. Therefore, it is possible to suppress fixation defects.

Figure 4:
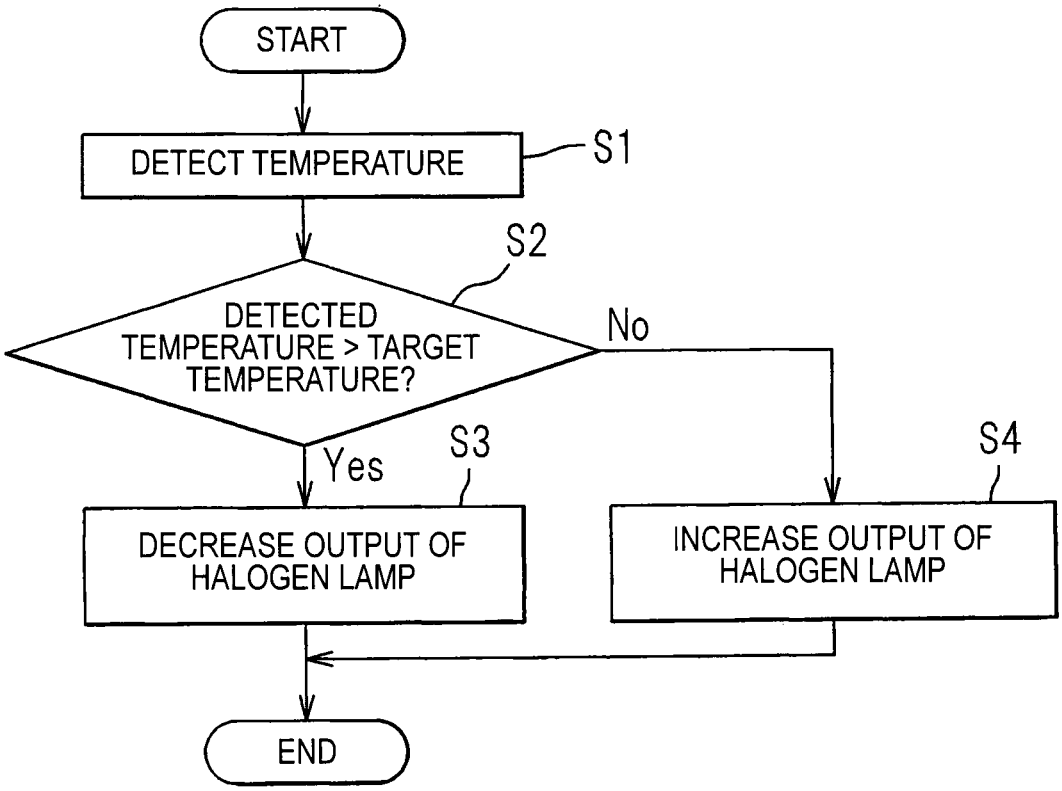
FIG. 4 is a flow chart illustrating the operation of a control unit during duplex printing.
Figure 5:
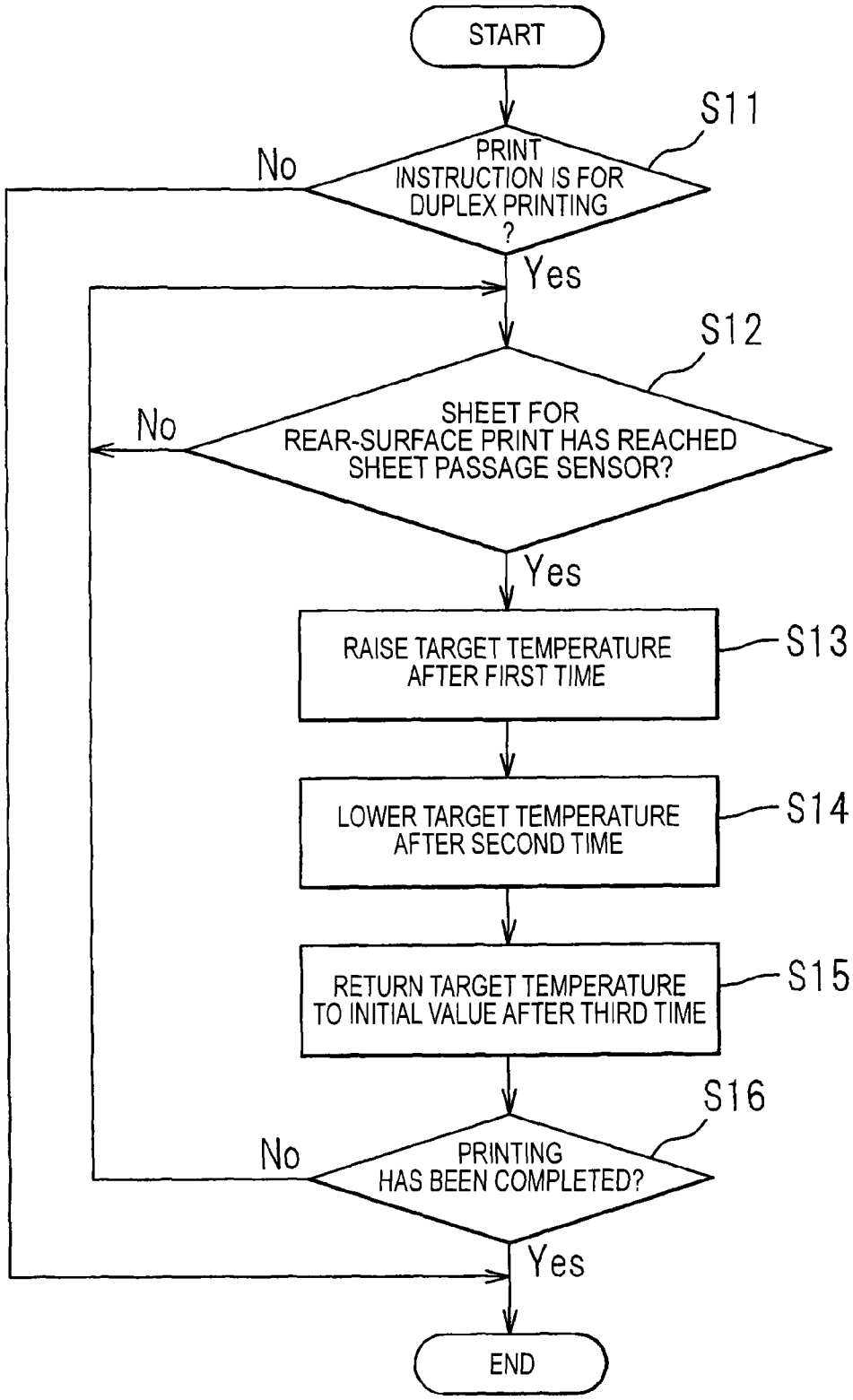
FIG. 5 is a flow chart illustrating a method of setting a target temperature during duplex printing.

The control unit 80 configured as described above performs control according to flow charts shown in FIGS. 4 and 5. During print control, the control unit 80 repeatedly performs the flow charts shown in FIGS. 4 and 5.

In the control of FIG. 4, first, the control unit 80 detects the temperature by the center thermistor 44 (step S1). After step S1, the control unit 80 determines whether the detected temperature is higher than the target temperature (step S2). The target temperature can be appropriately changed by the flow chart of FIG. 5 to be described below.

In a case where the detected temperature is higher than the target temperature in step S2 (Yes), the control unit 80 decreases the output of the halogen lamp 43 in step S3, and terminates the present control. Meanwhile, in a case where the detected temperature is not higher than the target temperature in step S2 (No), the control unit 80 increases the output of the halogen lamp 43 and terminates the present control (step S4). Specifically, in step S4, the control unit 80 necessarily increases the output at the time when the target temperature becomes the target temperature for the first time, and after that controls the output of the halogen lamp 43 according to the above-mentioned duty control.

In the control of FIG. 5, first, the control unit 80 determines whether the print instruction is an instruction to perform duplex printing on the plurality of sheets 3 (step S11). In a case where the print instruction is for duplex printing in step S11 (Yes), the control unit 80 determines whether the front end of the sheet DX1 for rear-surface print has reached the sheet passage sensor 90 (step S12).

Here, the determination of step S12 can be performed, for example, based on the ON/OFF history of the sheet passage sensor 90 after receiving the duplex printing instruction.

In a case where it is determined in step S12 that the sheet DX1 has reached the sheet passage sensor 90 (Yes), the control unit 80 raises the target temperature after a first time from that time point (in other words, immediately before the front end of the sheet DX1 reaches the nip portion)(step S13). After step S13, the control unit 80 steps down the target temperature after a second time from that time point (in other words, after the rear end of the sheet DX1 leaves the nip portion) (step S14).

After step S14, the control unit 80 returns the target temperature to the initial value after a third time from that time point (in other words, after the rear end of the sheet SX2 leaves the nip portion) (step S15). After step S15, the control unit 80 determines whether duplex printing on all of the plurality of sheets 3 has terminated (step S16).

In a case where the duplex printing has not entirely terminated in step S16 (No), or in a case where the detection result of step S12 is 'No', the control unit 80 returns to the process of step S12. In a case where the duplex printing has entirely terminated in step S16 (Yes), or in a case where the detection result of step S11 is 'No', the control unit 80 terminates the present control.

Also, this disclosure is not limited to the above-mentioned embodiment, but can be used in various forms as exemplified below.

In the present embodiment, the control unit 80 grasps the timing when the front end of the sheet DX1 for rear-surface print will reach the nip portion, by the processes of steps S12 and S13. However, this disclosure is not limited thereto. For example, since the control unit controls the double-side conveyance path unit 60, the registration rollers 17, and the like for conveying the sheet DX1 for rear-surface print, the control unit may determine the timing when the sheet DX1 for rear-surface print will reach the nip portion, for example, by the time from when the double-side conveyance path unit 60 is switched from a stop state to a driven state, or based on the stop/rotation history of the registration rollers 17.

In the present embodiment, the number of sheets 3 to be sequentially conveyed at the second interval T2 has been set to 2. However, this disclosure is not limited thereto. This disclosure can be applied to a form in which three or more sheets are conveyed at the second interval.

In the above-mentioned embodiment, as an example of the heat source, the halogen lamp 120 has been exemplified. However, this disclosure is not limited thereto. The heat source may be, for example, a heat element, an IH heat source, or the like. Here, the IH heat source refers to a heat source which does not produce heat by itself but makes a roller or a metal belt produce heat according to an electromagnetic-induction heating scheme.

Figure 6:
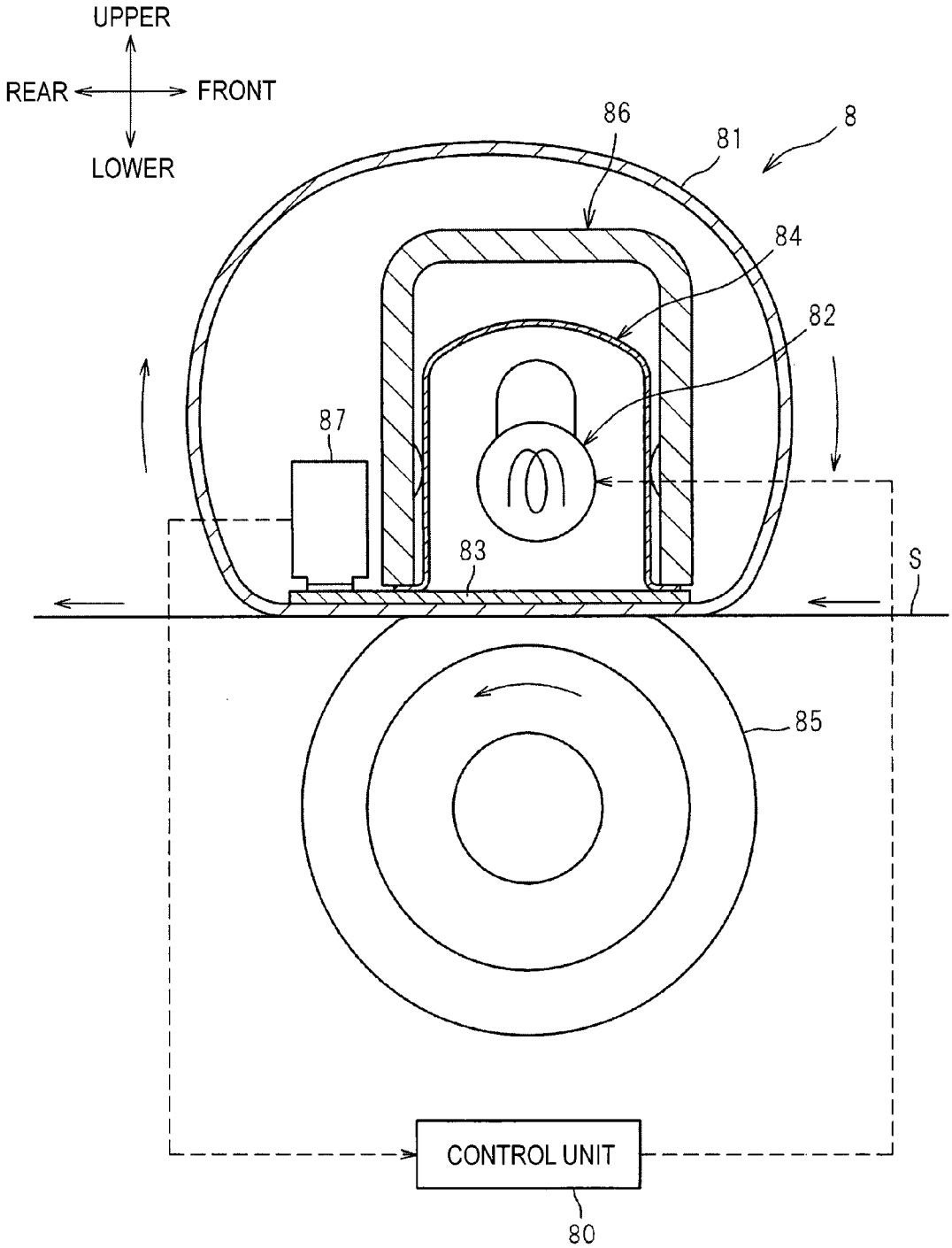
FIG. 6 is a view illustrating a modification of a heating member.

In the above-mentioned embodiment, as the heating member, the heating roller 41 has been exemplified. However, this disclosure is not limited thereto. For example, the heating member may be a nip plate 83 which is heated by the halogen lamp 82 as shown in FIG. 6. This disclosure is specifically effective in a belt fixing scheme in which the heat capacity of a heating unit (the nip plate 83) as shown in FIG. 6 is small. Hereinafter, a fixing device 8 shown in FIG. 6 will be described in brief.

The fixing device 8 mainly includes a fixing belt 81, the halogen lamp 82, the nip plate 83, a reflective plate 84, a backup roller 85, a stay 86, and a thermistor 87.

The fixing belt 81 is an endless (cylindrical) belt having heat resistance and flexibility, and both end portions of the fixing belt 81 are guided to be rotatable by a guide member (now shown).

The halogen lamp 82 is a heater for generating heat by electricity and heating the nip plate 83 and the fixing belt 81, thereby heating toner transferred on a sheet S, and it is disposed inside the fixing belt 81.

The nip plate 83 is a plate-like member which receives radiant heat from the halogen lamp 120, and it is disposed to be in sliding contact with the inner circumferential surface of the fixing belt 81. In order to transfer the radiant heat received from the halogen lamp 82 to the toner on the sheet S through the fixing belt 81, for example, the nip plate 83 is made of an aluminum plate or the like having high heat conductivity. Also, between the nip plate 83 and the fixing belt 81, heat-resistant lubricant (not shown) such as fluorine grease is held to reduce friction between the nip plate 83 and the fixing belt 81 rotating.

The reflective plate 84 is a member for reflecting the radiant heat from the halogen lamp 82 toward the nip plate 83, and it is disposed on the inside of the fixing belt 81 to surround the halogen lamp 82. The reflective plate 84 is formed by bending, for example, an aluminum plate having high reflectivity for infrared rays and far infrared rays, almost in a U shape in a cross-sectional view.

The backup roller 85 is a roller for pressing toner transferred on the sheet S while conveying the sheet S between the backup roller 85 and the fixing belt 81, and it is disposed below the nip plate 83 with the fixing belt 81 interposed therebetween. The backup roller 85 is rotated by a driving force transmitted from a motor (not shown) provided inside the main body 2, and rotates the fixing belt 81 by a frictional force with the fixing belt 81 (or the sheet S) at that time.

The stay 86 is a member for supporting the nip plate 83 through the reflective plate 84, thereby securing the rigidity of the nip plate 83 receiving a load from the backup roller 85, and it is disposed to cover the reflective plate 84. The stay 86 is formed by bending a material having relatively high rigidity, for example, a steel plate.

The thermistor 87 is a member for detecting the temperature of the fixing device 8, and it is disposed inside the fixing belt 81 of the fixing device 8. More specifically, the thermistor 87 is disposed to face the nip plate 83 whose temperature detection surface is heated by the halogen lamp 82, and detects the temperature of the nip plate 83 as the temperature of the fixing device 8. A detection signal of the thermistor 87 is output to a control unit 80 configured like the above-mentioned embodiment.

In the above-mentioned embodiment, as the backup member, the pressing roller 42 has been exemplified. However, this disclosure is not limited thereto. For example, the backup member may be a belt-like pressing member or the like.

In the above-mentioned embodiment, as an example of the recording sheet, the sheets 3 such as thick sheet, card, and thin sheet have been used. However, this disclosure is not limited thereto. For example, the recording sheet may be an OHP sheet.

In the above-mentioned embodiment, the output of the halogen lamp 43 increases immediately before the front end of the first sheet DX1 of the two sheets 3 conveyed at the second interval T2 reaches the nip portion. However, this disclosure is not limited thereto. The output of the heat source may increase when the front end reaches the nip portion, or immediately after the front end reaches the nip portion, or the like. Also, similarly, the output of the heat source may decrease immediately before the rear end of the last sheet SX1 of the two sheets 3 conveyed at the second interval T2 reaches the nip portion, or when the rear end reaches the nip portion, or the like.

In the above-mentioned embodiment, as an example of the temperature detecting member, the center thermistor 44 has been exemplified. However, this disclosure is not limited thereto. The temperature detecting member may be a side thermistor for detecting, for example, the temperature of an end portion of the heating roller, or the like.

In the above-mentioned embodiment, the target temperature is stepwise lowered to the initial value. However, this disclosure is not limited thereto. For example, the target temperature may be lowered to the initial value with a predetermined gradient.

In the above-mentioned embodiment, this disclosure has been applied to the laser printer 1. However, this disclosure is not limited thereto. This disclosure may be applied to other image forming apparatuses, for example, copy machines, multi-function apparatuses, and so on.

What is claimed is:

1. An image forming apparatus comprising:

a heating unit including:

a heating member;

a heat source configured to heat the heating member; and a backup member facing the heating member, a nip portion being defined between the heating member and the backup member;

a feeding unit configured to feed a recording sheet toward the nip portion; and a control unit configured to:

control the feeding unit such that each of a plurality of recording sheets is fed to the nip portion at one of a first interval and a second interval smaller than the first interval, two of the plurality of the recording sheets being sequentially conveyed at the second interval to each other, a first recording sheet of the two of the plurality of the recording sheets being fed to have the first interval with respect to a previously conveyed recording sheet, and increase an output of the heat source when a front end of the first recording sheet reaches a periphery of the nip portion, wherein the control unit alternately performs a conveyance at the first interval and a conveyance at the second interval.

2. The image forming apparatus according to claim 1, wherein the control unit is configured to increase the output of the heat source immediately before the front end of the first sheet reaches the nip portion.

3. The image forming apparatus according to claim 1, wherein the control unit is configured to decrease the output of the heat source on a timing when a rear end of the first recording sheet reaches the periphery of the nip portion.

4. The image forming apparatus according to claim 1, wherein the control unit is configured to decrease the output of the heat source when a rear end of a last recording sheet of the two of the plurality of recording sheets sequentially conveyed at the second interval reaches the periphery of the nip portion.

5. The image forming apparatus according to claim 4, wherein the control unit is configured to decrease the output of the heat source after the rear end of the last recording sheet of the two of the plurality of recording sheets sequentially conveyed at the second interval leaves the periphery of the nip portion.

6. The image forming apparatus according to claim 1, wherein when performing duplex printing on the recording sheets, the control unit is configured to alternately perform the conveyance at the first interval and the conveyance at the second interval.

7. The image forming apparatus according to claim 1, further comprising:

a temperature detecting member configured to detect the temperature of the heating unit, wherein, in a case where a current value of a detected temperature detected by the temperature detecting member is lower than a target temperature, the control unit is configured to increase the output of the heat source, and wherein, in a case where the current value is higher than the target temperature, the control unit is configured to decrease the output of the heat source.

8. The image forming apparatus according to claim 7, wherein the control unit is configured to change the target temperature to change the output of the heat source.

9. The image forming apparatus according to claim 8, wherein, in a case of lowering the target temperature having greatly changed from an initial value to the initial value, the control unit is configured to gradually lower the target temperature to the initial value.

* * * * *